United States Patent [19]

Johnson et al.

[11] Patent Number: 4,821,040

[45] Date of Patent: Apr. 11, 1989

[54] CIRCULAR MICROSTRIP VEHICULAR RF ANTENNA

[75] Inventors: Russell W. Johnson; Robert E. Munson, both of Boulder, Colo.

[73] Assignee: Ball Corporation, Muncie, Ind.

[21] Appl. No.: 945,613

[22] Filed: Dec. 23, 1986

[51] Int. Cl.[4] ..... H01Q 1/32; H01Q 9/04

[52] U.S. Cl. ..... 343/700 MS; 343/713; 343/769; 343/770; 343/789

[58] Field of Search ..... 343/700 MS, 789, 711–713, 343/769, 770, 846

[56] References Cited

U.S. PATENT DOCUMENTS

| | | | |
|---|---|---|---|
| 1,649,510 | 11/1927 | Clough | 343/713 |
| 2,063,531 | 12/1936 | Tuttle | 343/713 |
| 2,351,947 | 6/1944 | Gabler | 343/712 |
| 2,508,085 | 5/1950 | Alford | 343/769 |
| 2,659,003 | 11/1953 | Dorne et al. | 343/772 |
| 2,996,713 | 8/1961 | Boyer | 343/700 MS |
| 3,465,985 | 9/1969 | Von Gohren | 343/708 |
| 3,611,388 | 10/1971 | Okumura | 343/712 |
| 3,623,108 | 11/1971 | DuBois et al. | 343/712 |
| 3,680,136 | 7/1972 | Collings | 343/700 MS |
| 3,710,338 | 1/1973 | Munson | 343/708 |
| 3,714,659 | 1/1973 | Firman | 343/701 |
| 3,736,591 | 5/1973 | Rennels et al. | 343/702 |
| 3,739,386 | 6/1973 | Jones | 343/708 |
| 3,939,423 | 2/1976 | Zakharov et al. | 343/712 |
| 4,051,477 | 9/1977 | Murphy et al. | 343/700 MS |
| 4,080,603 | 3/1978 | Moody | 343/712 |
| 4,124,851 | 11/1978 | Aaron et al. | 343/772 |
| 4,131,893 | 12/1978 | Munson et al. | 343/700 MS |
| 4,184,160 | 1/1980 | Affronti | 343/712 |
| 4,208,660 | 6/1980 | McOwen | 343/789 |
| 4,317,121 | 2/1982 | Allen, Jr. et al. | 343/712 |
| 4,379,296 | 4/1983 | Farrar et al. | 343/700 MS |
| 4,521,781 | 6/1985 | Campi et al. | 343/700 MS |
| 4,538,153 | 8/1985 | Taga | 343/700 MS |
| 4,600,018 | 7/1986 | James et al. | 343/700 MS |
| 4,605,933 | 8/1986 | Butscher | 343/700 MS |
| 4,707,700 | 11/1987 | Nagy | 343/712 |
| 4,717,920 | 1/1988 | Ohe et al. | 343/712 |

FOREIGN PATENT DOCUMENTS

| | | | |
|---|---|---|---|
| 0163454 | 12/1985 | European Pat. Off. | 343/700 MS |
| 174068 | 3/1986 | European Pat. Off. | 343/700 MS |
| 57-63904 | 4/1982 | Japan | 343/700 MS |
| 57-75005 | 5/1982 | Japan | 343/700 MS |
| 59-16402 | 1/1984 | Japan | 343/700 MS |
| 0007204 | 1/1985 | Japan | 343/702 |
| 1457173 | 12/1976 | United Kingdom | 343/700 MS |
| 1103316 | 7/1984 | U.S.S.R. | 343/700 MS |

*Primary Examiner*—William L. Sikes
*Assistant Examiner*—Michael C. Wimer
*Attorney, Agent, or Firm*—Gilbert E. Alberding

[57] ABSTRACT

A compact, easy to manufacture quarter-wavelength microstrip element especially suited for use as a mobile radio antenna has performance which is equal to or better than conventional quarter wavelength whip-type mobile radio antennas. The antenna is not visible to a passerby observer when installed, since it is literally part of the vehicle. The microstrip radiating element is conformal to a passenger vehicle, and may, for example, be mounted under a plastic roof between the roof and the headliner.

25 Claims, 8 Drawing Sheets

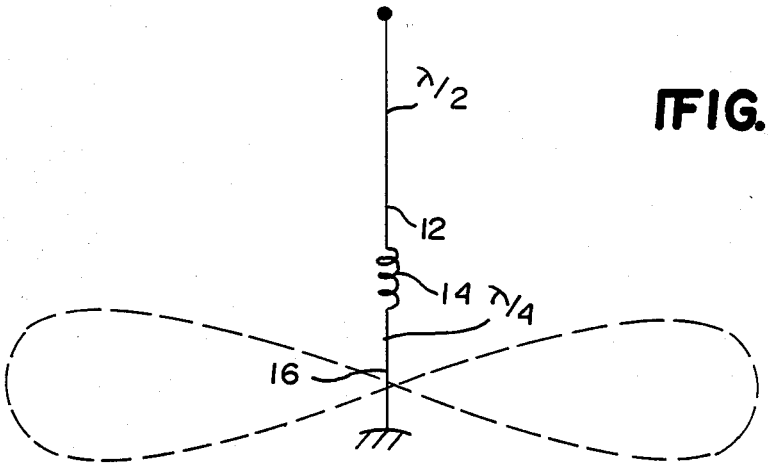
FIG. 1 PRIOR ART
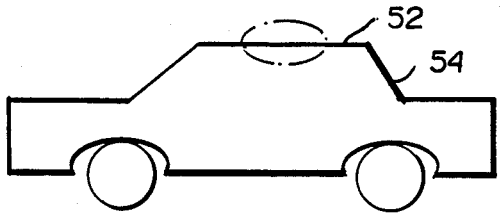
FIG. 2
FIG. 3
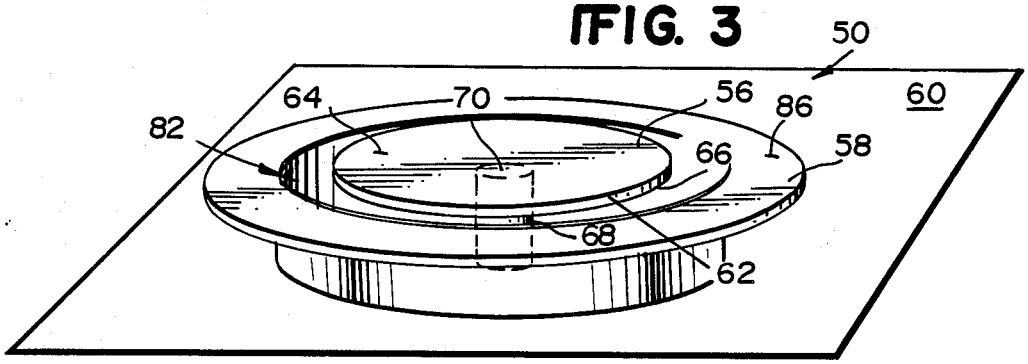
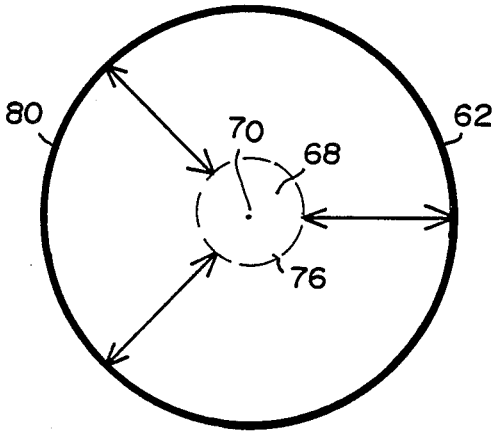
FIG. 4 (A)

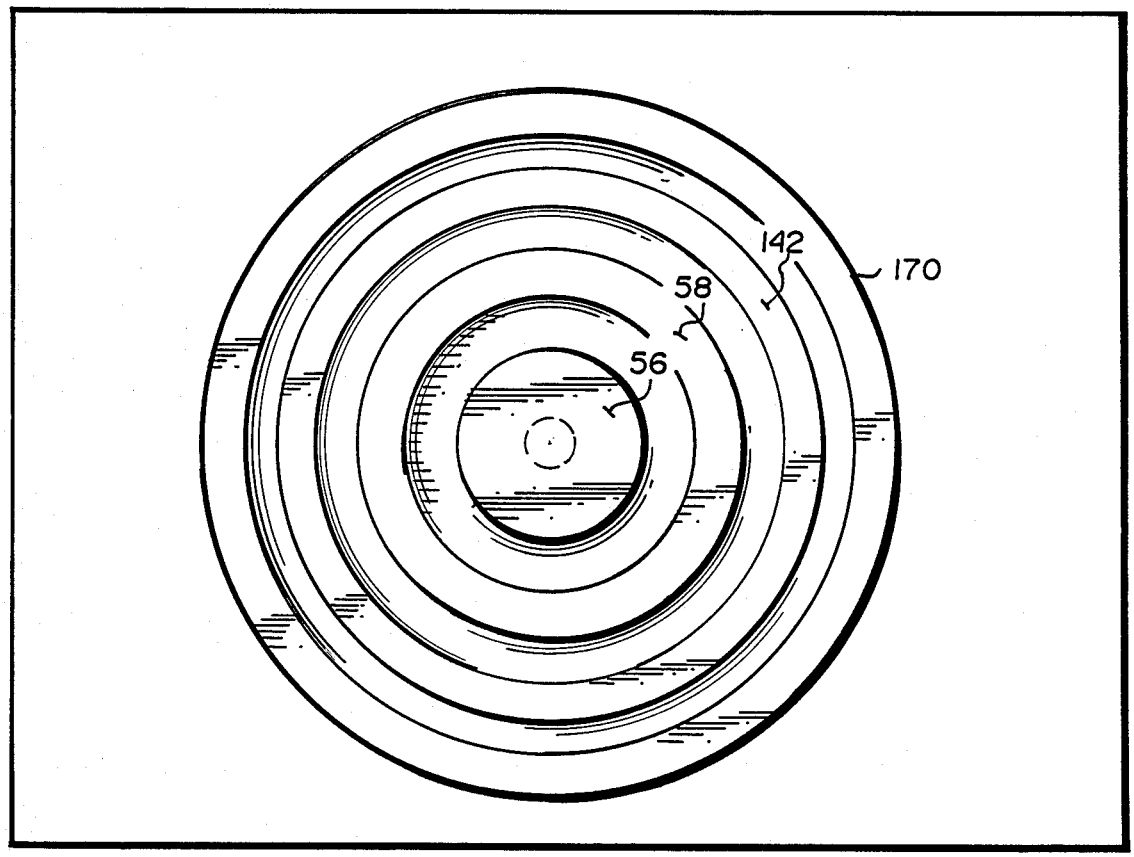
FIG. 8
FIG. 10
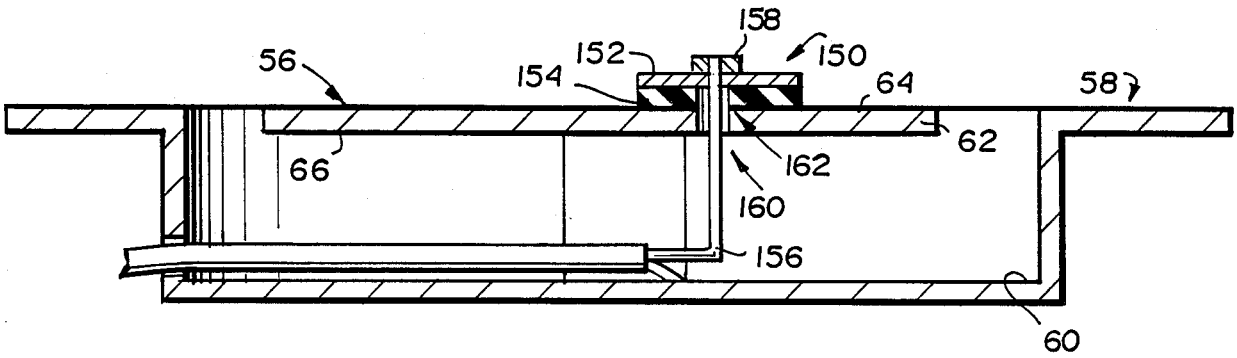

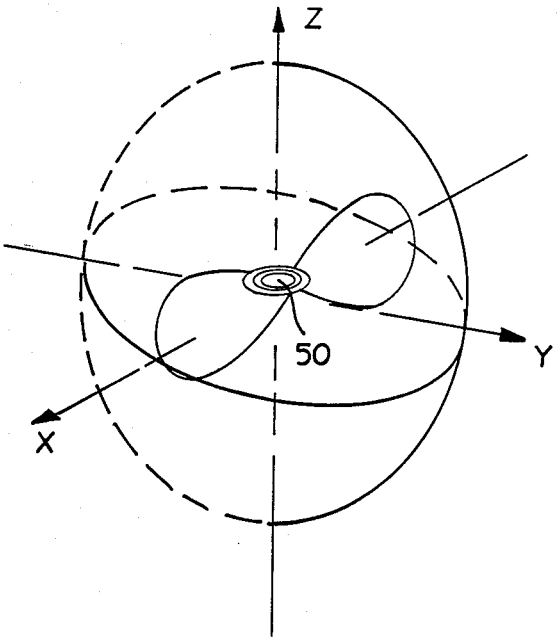
FIG. 11
FIG. 12
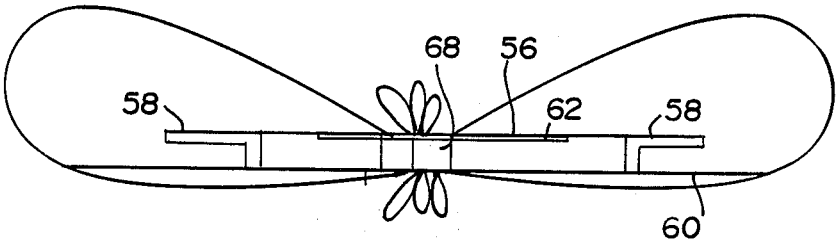
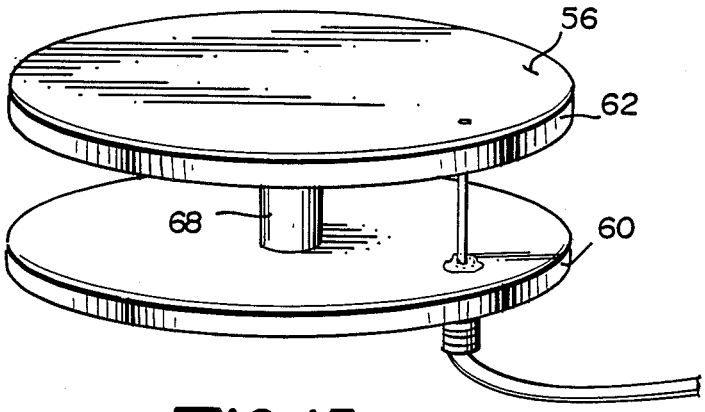
FIG. 15

CIRCULAR MICROSTRIP VEHICULAR RF ANTENNA

This application is related to copending commonly-assigned application Ser. No. 946,788 of Johnson et al, filed Dec. 29, 1986 entitled "NEAR-ISOTROPIC LOW-PROFILE MICROSTRIP RADIATOR ESPECIALLY SUITED FOR USE AS A MOBILE VEHICLE ANTENNA", the disclosure of which is incorporated by reference herein.

This invention generally relates to radio-frequency antenna structures and, more particularly, to low-profile resonant microstrip antenna radiators.

Microstrip antennas of many types are well known in the art. Briefly, microstrip antenna radiators comprise resonantly dimensioned conductive surfaces disposed less than about 1/10th of a wave length above a more extensive underlying conductive ground plane. The radiator element may be spaced above the ground plane by an intermediate dielectric layer or by a suitable mechanical standoff post or the like. In some forms (especially at higher frequencies), microstrip radiators and interconnecting microstrip RF feedline structures are formed by photochemical etching techniques (like those used to form printed circuits) on one side of a doubly clad dielectric sheet, with the other side of the sheet providing at least part of the underlying ground plane or conductive reference surface.

Microstrip radiators of various types have become quite popular due to several desirable electrical and mechanical characteristics. The following listed references are generally relevant in disclosing microstrip radiating structures:

| Inventor | Patent No. | Issued |
|---|---|---|
| Murphy et al | 4,051,477 | Sep. 27, 1977 |
| Taga | 4,538,153 | Aug. 27, 1985 |
| Campi et al | 4,521,781 | Jun. 4, 1985 |
| Munson | 3,710,338 | Jan. 9, 1973 |
| Sugita | Jap. 57-63904 | Apr. 17, 1982 |
| Jones | 3,739,386 | Jun. 12, 1973 |
| Firman | 3,714,659 | Jan. 30, 1973 |
| Farrar et al | 4,379,296 | Apr. 5, 1983 |

Although microstrip antenna structures have found wide use in military and industrial applications, the use of microstrip antennas in consumer applications has been far more limited—despite the fact that a great many consumers use high frequency radio communications every day. For example, cellular car radio telephones, which are becoming more and more popular and pervasive, could benefit from a low-profile microstrip antenna radiating element if such an element could be conveniently mounted on or in a motor vehicle in a manner which protects the element from the environment—and if such an element could provide sufficient bandwidth and omni-directivity once installed.

The following list of patents are generally relevant in disclosing automobile antenna structures:

| Inventor | Patent No. | Issued |
|---|---|---|
| Moody | 4,080,603 | Mar. 21, 1978 |
| Affronti | 4,184,160 | Jan. 15, 1980 |
| DuBois et al | 3,623,108 | Nov. 23, 1971 |
| Zakharov et al | 3,939,423 | Feb. 17, 1976 |
| Chardin | UK 1,457,173 | Dec. 1, 1976 |
| Boyer | 2,996,713 | Aug. 15, 1961 |

-continued

| Inventor | Patent No. | Issued |
|---|---|---|
| Allen, Jr., et al | 4,317,121 | Feb. 23, 1982 |
| Gabler | 2,351,947 | June 20, 1944 |
| Okumura | 3,611,388 | October 5, 1971 |

Mobile radio communications presently relies on conventional whip-type antennas mounted to the roof, hood, or trunk of a motor vehicle. This type of conventional whip antenna is shown in prior art FIG. 1. A conventional whip antenna typically includes a half-wavelength vertically-oriented radiating element 12 connected by a loading coil 14 to a quarter-wavelength vertically-oriented radiating element 16. The quarter-wavelength element 16 is mechanically mounted to a part of the vehicle.

Although this type of whip antenna generally provides acceptable mobile communications performance, it has a number of disadvantages. For example, a whip antenna must be mounted on an exterior surface of the vehicle, so that the antenna is unprotected from the weather (and may be damaged by car washes unless temporarily removed). Also, the presence of a whip antenna on the exterior of a car is a good clue to thieves that an expensive radio telephone transceiver probably is installed within the car.

The Moody and Affronti patents listed above disclose externally-mounted vehicle antennas which have some or all of the disadvantages of the whip-type antenna.

The DuBois and Zakharov et al patents disclose antenna structures which are mounted in or near motor vehicle windshields within the vehicle passenger compartment. While these antennas are not as conspicuous as externally-mounted whip antennas, the significant metallic structures surrounding them may degrade their radiation patterns.

The Chardin British patent specification discloses a portable antenna structure comprising two opposed, spaced apart, electrically conductive surfaces connected together by a lump-impedance resonant circuit. One of the sheets taught by the Chardin specification is a metal plate integral to the metal chassis of a radio transceiving apparatus, while the other sheet is a metal plate (or a piece of copper-clad laminate of the type used for printed circuit boards) which is spaced away from the first sheet.

The Boyer patent discloses a radio wave-guide antenna including a circular flat metallic sheet uniformly spaced above a metallic vehicle roof and fed through a capacitor.

Gabler and Allen Jr., et al disclose high frequency antenna structures mounted integrally with non-metallic vehicle roof structures.

Okumura et al teaches a broadcast band radio antenna mounted integrally within the trunk lid of a car.

It would be highly desirable to provide a low profile microstrip-style radiating element which has a relatively large bandwidth, can be inexpensively produced in high volumes, can be installed integrally within or inside a structure found in most passenger vehicles, and which provides a nearly isotropic vertical directivity pattern.

SUMMARY OF THE INVENTION

The present invention provides a circularly shaped conductive radiator element of less than one-half wavelength in diameter spaced above a conductive reference surface by substantially less than one-fourth wavelength. The circularly shaped radiator element is electrically shorted to the reference surface near the center of the element to form a shorted annular cavity having a circular radiating slot at its outer edge. An RF signal feed connection connected between the reference surface and a predetermined matched impedance point on the circular radiator element couples RF energy to/-from the antenna structure.

A further annular conductive radiator element(s) may be disposed above the reference surface by substantially less than one-fourth wavelength and spaced radially outwardly from the circular radiating slot formed by the circular radiator element. This further radiator element(s) also have resonant radial dimensions to form further circular radiating slots at their edges.

The antenna structure provided by the present invention has relatively broadband characteristics (e.g., less than 2.0:1 VSWR over a frequency range of over 820 MHz–890 MHz), is vertically polarized, and is substantially omni-directional. The antenna structure of the invention is therefore ideal for installation in an automobile of the type having a passenger compartment roof including a rigid, outer non-conductive shell and an inner headliner layer spaced apart from the outer shell to define a cavity therebetween. The antenna structure may be disposed within that cavity, preferably with the radiator element and/or passive element mechanically mounted to an inside surface of the outer shell.

The antenna structure of the invention may be inexpensively mass-produced using die stamping techniques. A discoid piece of metal may be die stamped to draw a cylindrical protruding portion from its center. A larger discoid piece of metal may be die stamped to provide a cylindrical cup-shaped portion having a circular flat bottom, a cylindrical side wall, and an annular outwardly extending flange portion extending from the upper edge of the side wall. The part with the cylindrical protruding portion is disposed within the cup-shaped portion of the other part, and the protruding portion is attached to the bottom of the cup-shaped portion (e.g., by inserting tabs extending from the protruding portion into corresponding slots in the circular bottom). The process of manufacture described above may be used to mass produce the antenna structure of the present invention at very low cost.

BRIEF DESCRIPTION OF THE DRAWINGS

These and other features and advantages of the present invention may be better and more completely understood by referring to the following detailed description of preferred embodiments in conjunction with appended sheets of drawings, of which:

FIG. 1 is a schematic side view of a prior art whip-type quarter-wavelength mobile antenna radiator;

FIG. 2 is a schematic view of a passenger vehicle and roof structure;

FIG. 3 is a side view in perspective of a presently preferred exemplary embodiment of the antenna structure provided by the present invention, this embodiment including a circular radiator element and a single annular parasitic element;

FIG. 4A is a top view in plan of the circular radiator element shown in FIG. 3 schematically illustrating the resonantly-dimensioned annular resonant cavity defined between that radiator element and a reference surface;

FIG. 8 is a top view in plan of the embodiment shown in FIG. 7;

FIG. 10 is a side view in cross-section of the embodiment shown in FIG. 5 incorporating the capacitive stub impedance matching network of FIG. 9;

FIG. 11 is a side perspective schematic view of the radiation pattern of the antenna structure of the present invention;

FIG. 12 is a side schematic view of the radiation pattern of the embodiment shown in FIG. 3;

FIG. 15 is a side view in perspective of a further embodiment of the present invention having a circular reference surface which is coextensive with the circular radiator element.

DETAILED DESCRIPTION OF PREFERRED EMBODIMENTS

Figure 4:
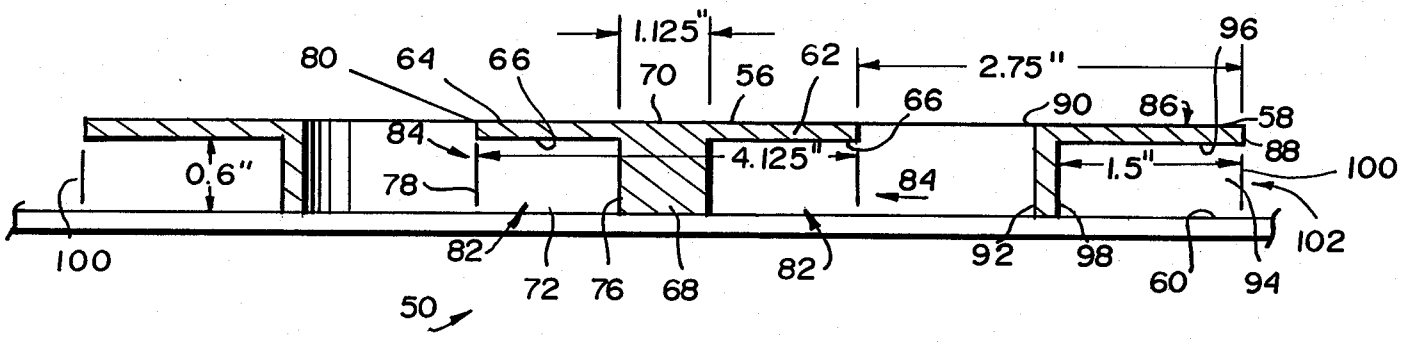
FIG. 4 is a side view in cross-section of the embodiment shown in FIG. 3.

FIG. 3 is a side perspective view of a presently preferred exemplary embodiment of a vehicle-installed ultra high frequency (UHF) radio frequency antenna structure 50 in accordance with the present invention.

Antenna structure 50 is installed within a roof structure 52 of a passenger automobile 54 (or other vehicle) in the preferred embodiment (see FIG. 2). Antenna structure 50 is of a "low profile" design so that it may actually be integrally incorporated into roof structure 52.

The embodiment of antenna structure 50 shown in FIG. 3 includes three elements: a circular conductive radiator element 56; an annular parasitic element 58; and a conductive reference surface ("ground plane") 60. The structure of element 56 of the preferred embodiment will now be discussed.

As can best be seen in FIGS. 3 and 4 together, circular radiator element 56 includes a substantially flat disk 62 of conductive material (e.g., aluminum or copper). Disk 62 has a flat, circular upper surface 64 and a flat circular lower surface 66. A cylindrical post 68 (which may be hollow if desired) made of conductive material is electrically connected (e.g., by a conductive fastener passing through disk 62, post 68 and reference surface 60) to disk lower surface 66 at substantially the center of disk 62 and is also conductively bonded to reference surface 60. Post 68 spaces disk 62 above reference surface 60, and also defines an annular resonant cavity, as will now be explained.

The diameter of disk 62 and the diameter of cylindrical post 68 are chosen based upon the desired RF operating frequency range of antenna structure 50 such that an annular resonant cavity is defined between disk lower surface 66 and reference surface 60 (the reference can be a flat sheet of copper 10 inches by 16 inches if desired). Thus, a cross-sectional volume 72 bounded by reference surface 60, cylindrical post outer wall 76, disk lower surface 66, and an imaginary line 78 drawn normal to disk lower surface 66 and reference surface 60 between disk outer periphery 80 and the reference surface forms a resonant cavity. The same is true along each and every radius of disk 62 due to the symmetry of the disk and cylindrical post 68 (see FIG. 4A). Thus, the volume between disk lower surface 66 and reference surface 60 may be considered a shorted annular cavity 82. A circular radiating slot 84 is formed along the gap between disk outer periphery 80 and conductive reference surface 60.

In the preferred embodiment, post 68 has a diameter of approximately 1.125 inches and a height of approximately 0.6 inches to 0.75 inches; and disk 62 has a diameter of approximately 4.125 inches (which is substantially less than one-half wavelength) for a desired center operating frequency of about 857 MHz.

Disk 62, post 68 and conductive reference surface 60 can be used without any additional structure as a UHF RF antenna with many advantages. Because of the symmetry of this combination of elements, the resulting antenna has a substantially omni-directional vertically polarized radiation pattern. The structure also has relatively broadband characteristics due to its circularly symmetric configuration, and may be fed directly by a coaxial RF transmission line if desired (e.g., by simply connecting the coax center conductor or associated standard coaxial connector center pin to an experimentally-determined point on disk lower surface 66 somewhere between post 68 and disk outer periphery 80 which yields an optimum impedance match).

It has been found that the antenna structure bandwidth increases as the height of post 68 (and thus, the spacing between disk lower surface 66 and reference surface 60) is increased. However, the spacing between disk lower surface 66 and reference surface 60 should preferably remain substantially less than a quarter wavelength if the antenna directivity and other performance characteristics described herein are desired (since the antenna would have the characteristics of a quarter wavelength top-loaded vertical monopole rather than those of a circular radiating slot if the electrical height of post 68 were on the order of a quarter wavelength).

It may be desirable (e.g., in certain mobile radio applications) to reduce the angle of radiation of antenna structure 50 in order to increase the effective gain of the antenna structure along radiation paths approximately within the plane of disk 62. For example, most land targets which an operator within automobile 54 desires to communicate with (e.g., other mobile radio transceiver antennas, base station antennas, etc.) will probably be located approximately within the plane of disk 62 (that is, somewhere along the horizon if the disk is oriented parallel to the surface of the earth). It may therefore be desirable to increase the amplitude of the radiation lobes toward the horizon and increase the area covered by the null directly above disk 62 (see, for example, FIG. 13).

The gain of antenna structure 50 toward the horizon can be increased and the angle of radiation of the antenna structure can be lowered by providing one or more annular "director" parasitic elements 58 to direct radiated energy towards the horizon. A discussion of the structure and operation of such parasitic elements will now be presented.

The embodiment shown in FIGS. 3 and 4 includes a single parasitic element 58. Parasitic element 58 includes a circular flat ring ("annulus") 86 spaced above conductor reference surface 60 and preferably lying within the plane of disk 62. As can best be seen in FIG. 4, ring 86 has a free circular periphery edge 88 and a further edge 90. Edge 90 is electrically shorted to reference surface 60 by shorting portion 92 (shorting portion also is used in the preferred embodiment to support ring 86 above reference surface 60). Ring 86 is concentric with disk 62—that is, the center point of the circle defined by the ring and the center point of disk 62 are the same.

Ring 86 is preferably parallel to reference surface 60 (as is disk 62). The width of ring 86 (i.e., the distance between ring peripheral edge 88 and shorting portion 92) is selected based upon desired operating frequency so that an annular resonant cavity 94 is formed, this cavity being bounded by a ring lower surface 96, a shorted portion inner surface 98, conductive reference surface 60, and an imaginary line 100 normal to both reference surface 60 and the plane of ring 86 and drawn between ring peripheral edge 88 and the reference surface. Resonant cavity 94 opens in a circular radiating slot 102 concentric with radiating slot 84.

In the preferred embodiment, the spacing between ring lower surface 96 and conductive reference surface 60 is approximately 0.6 inches to 0.75 inches (the same spacing as that between disk lower surface 66 and the reference surface); and the distance between shorting portion inner surface 98 and peripheral edge 88 is approximately 1.5 inches for a center operating frequency of 857 MHz.

As will be explained, circular radiator element 56 is driven (i.e., connected to an RF transmission line), and passive element 58 is parasitically coupled to element 56 (i.e., there is no direct connection between the transmission line and the parasitic element). Radiating slot 102 is a parasitic circular radiating slot concentric with the radiating slot 84 defined by driven element 56. The effect of parasitically-coupled radiating slot 102 is to decrease the angle of radiation of antenna structure 50 by directing more of the radiation emitted by radiator element 56 toward the horizon (and likewise, directing more of the radiation received from the horizon towards slot 84 when the antenna structure is used for receiving signals). Radiating slot 102 thus increases antenna gain at the horizon when radiator element 56 and ring 86 are horizontally disposed.

The spacing between slot 84 and slot 102 is critical to the radiation characteristics of antenna structure 50. An analogy may be drawn to the so called "Yagi" or "Yagi-Uda" antenna array, which includes self-resonant parasitic linear dipole-type elements spaced at 0.2 wavelength intervals. Discussions of such Yagi arrays may be found in a variety of publications including, for example, *The ARRL Antenna Book* (American Radio Relay League) beginning at page 145. The relationship between parasitic radiating slot 102 and radiating slot 104 is analogous to the relationship between a self-resonant director dipole parasitic element of a Yagi array and a driven dipole element of that array.

In the preferred embodiment of the present invention, the distance between parasitic radiating slot 102 and radiating slot 84 is nominally 0.2 wavelengths (2.75 inches for a center operating frequency of 857 MHz), although the actual spacing is preferably optimized through experimentation to obtain desired antenna performance characteristics and to ensure resonance (since the coupling between elements 56 and 58 may have an effect on the resonant frequencies of both of cavities 82 and 94).

The embodiment of antenna structure 50 shown in FIG. 3 may be fabricated by making disk 62, post 68, parasitic element 58 and conductive reference surface 60 individually from copper or other conductive material (using, for example, conventional metal cutting and machining processes) and then assembling the antenna structure using conventional fasteners (e.g., sheet metal screws and/or nuts and bolts). Prototypes of the invention have been made using such techniques. However, if antenna structure 50 is to be mass-produced for incorporation into hundreds of thousands (or millions) of passenger vehicles, it is desirable to use a fabrication process which is less costly and time consuming.

Figure 5:
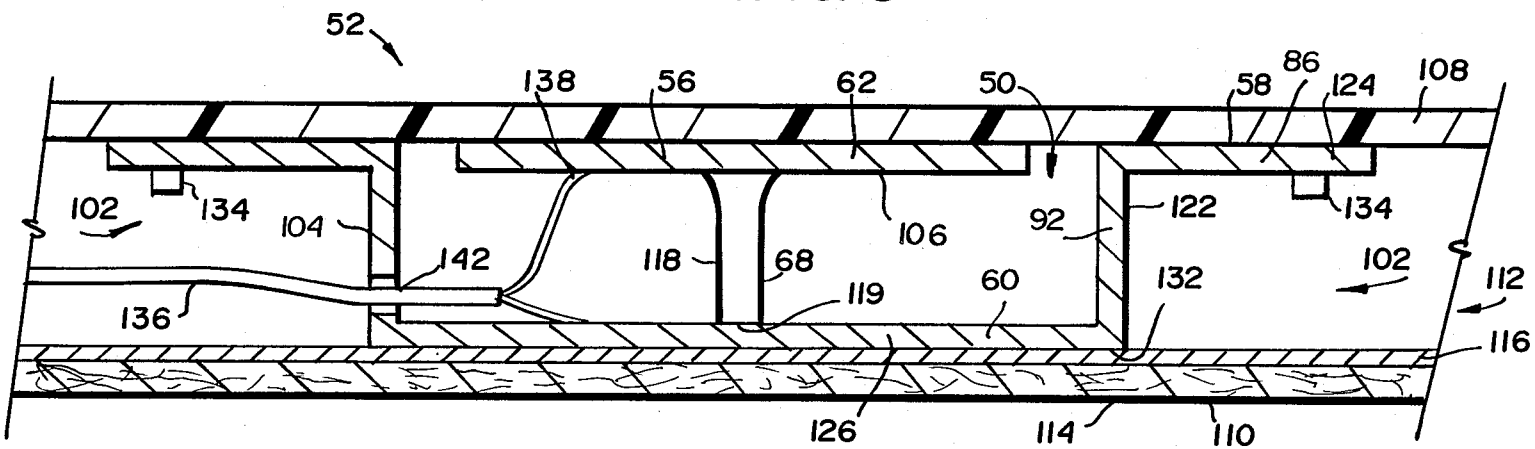
FIG. 5 is a side view in cross-section of a further embodiment of the antenna structure of the present invention installed in the automobile roof structure shown in FIG. 2, this embodiment also having a circular radiator element and a single annular parasitic element.

FIG. 5 is a side view in cross-section of another embodiment of antenna structure 50 having a circular radiator element 56 and a parasitic director element 58. The embodiment shown in FIG. 5 is integrally incorporated into vehicle roof structure 52, and is fabricated from two die-stamped parts 104 and 106 using fabrication processes which can readily yield high volumes of parts at very low cost.

Conventional automobile roof structure 52 of passenger automobile 54 includes an outer rigid non-conductive (e.g., plastic) shell 108 and an inner "headliner" layer 110 spaced apart from the outer shell to form a cavity 112 having a height of approximately one inch therebetween. Headliner 110 is typically made of cardboard or other inexpensive, thermally insulative material. A layer of foam or cloth (not shown) may be disposed on the headliner surface 114 bounding the passenger compartment of automobile 54 for aesthetic and other reasons. Headliner 110 is a structure typically thought of as the inside "roof" of the automobile passenger compartment (and on which the dome light is typically mounted). The outer shell 108 is self-supporting, and is rigid and strong enough to provide good protection against the weather.

The embodiment of antenna structure 50 shown in FIG. 5 is made of two parts: part 104 and part 106. Part 106 forms disk 62 and post 68, while part 104 forms ring 86, shorting portion 92 and conductive reference surface 60 (in conjunction with a layer of aluminum foil or other thin conductive layer which is electrically connected to the automobile chassis and acts as both a ground plane and as a shield to protect passengers within the vehicle from being exposed to microwaves).

Figure 6:
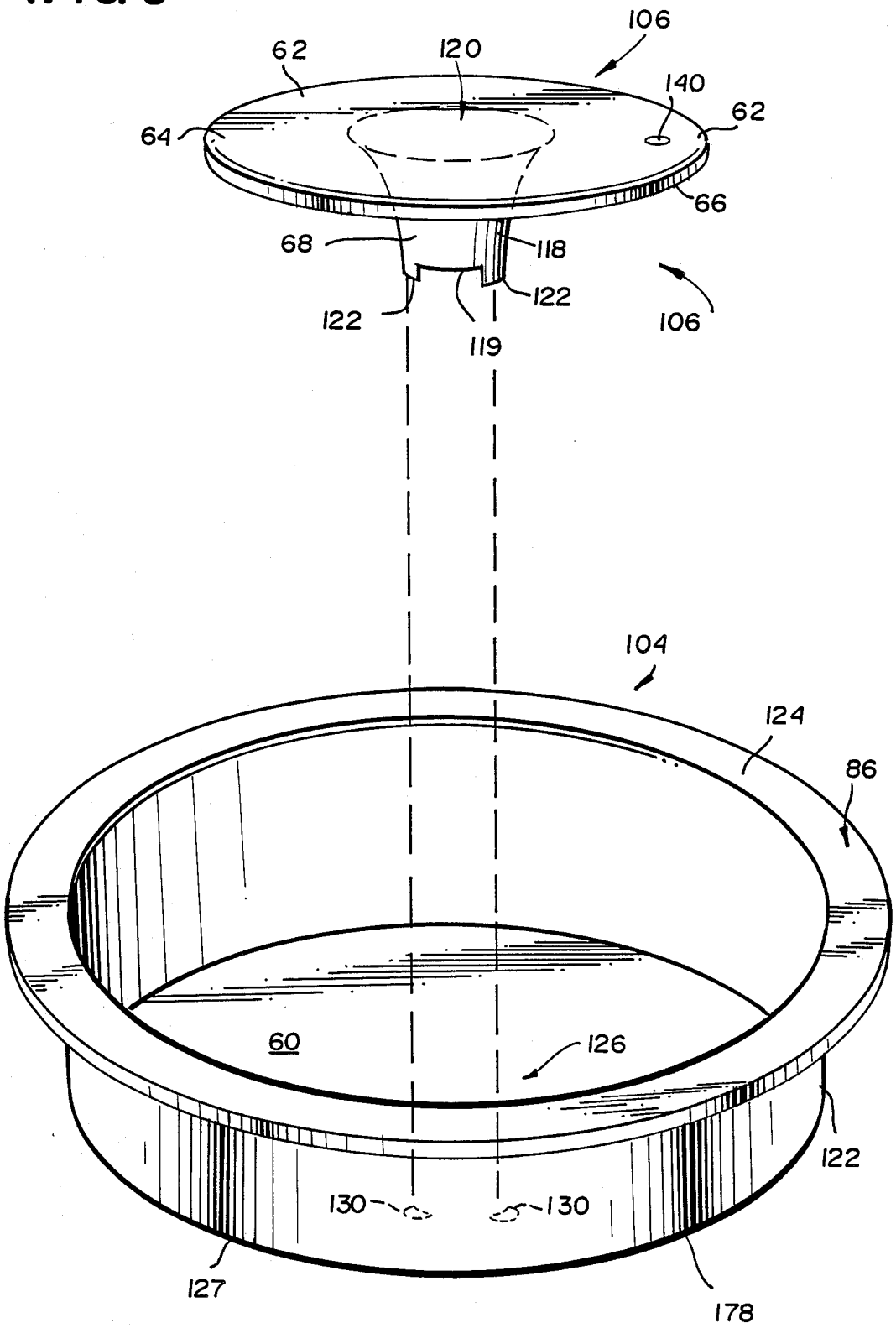
FIG. 6 is an exploded view in perspective of two die stamped parts which, when assembled together, form the antenna structure shown in FIG. 5.

Referring to FIG. 6, part 106 is fabricated by stamping a disk made of conductive metal (aluminum is preferred because of its low cost, light weight and ductility, although copper might be used instead) using a conventional die-stamping machine and die. The disk from which part 106 is stamped has a diameter which is preferably slightly larger than the desired diameter of disk 62, and has a thickness which is great enough to permit a projecting portion of a desired length (post 68) to be drawn from the disk center.

The disk from which part 106 is made is clamped about its periphery using a resilient clamp, and a rod-like stamping tool is then lowered into the center of the disk with sufficient force to draw the metal from the center of the disk downward (e.g., into a cylindrical bore positioned under the disk and aligned with the rod). Such conventional die stamping techniques are well known to those skilled in the art, and need not be discussed in detail herein (likewise, a variety of different die stamping techniques different from the technique just described might well be used to fabricate part 106).

The disk from which part 106 is made is stamped so that a projecting portion 118 is formed at the center of the disk and extends (downwardly in the orientation shown in FIG. 6) from disk lower surface 66. Projecting portion 118 is frustoconical at the point it joins with disk lower surface 66, and is cylindrical at its distal terminus 119. The resulting conical depression 120 in the center of disk upper surface 64 does not significantly degrade the performance of radiating element 56. Likewise, although post 68 is ideally cylindrical along its entire length so that annular cavity 72 has a the same dimension near reference surface 60 as near disk lower surface 66, the frustoconical, tapered shape of the post will not significantly degrade the resonant properties of annular cavity 84. As part of the same stamping step (or possibly, through an additional machining or stamping process occurring after the first stamping), "ears" or tabs 122 are formed which extend from distal terminus 119 of projecting portion 118 as shown.

To fabricate part 104, a larger circular disk (also of aluminum or copper) is stamped using a cylindrical die to form a cylindrical cup-shaped portion having a cylindrical side wall 122 and a circular bottom 126 (such techniques are commonly used to form cakepans and other similar articles). Subsquently to the stamping step, a conventional flanger is used to bend the upper edge of cup-shaped portion side wall 122 into an outwardly extending flange portion 124 (depending upon the type of flanger used, one or plural separate steps may be required to form an annular flange which meets cylindrical side wall 122 at a right angle).

Finished part 104 has a substantially flat, circular bottom 126 which closes the bottom edge 127 of cup-shaped portion 128. Flange 124 extends outwardly from the open edge of cylindrical portion 128, and preferably lies in a plane which is parallel to the plane containing bottom 126. Holes 130 corresponding to tabs 122 are preferably cut into bottom portion 126.

Parts 104, 106 are then assembled by inserting tabs 122 into holes 130 and bending the tabs over (or using some type of metal bonding/fastening technique such as soldering or brazing) so that protruding portion 118 (i.e., post 68) is approximately normal to bottom 126 and flange 124 (i.e., ring 86) is concentric with disk 62.

The resulting assembled structure is installed into vehicle roof structure 52 (see FIG. 5) by electrically coupling the lower conductive surface of bottom 126 to aluminum foil layer 116 (using conductive foil tape, by inserting the cup-shaped portion into a retaining ring (not shown) electrically and mechanically connected to the foil, or by some other cost-effective technique) and also by mechanically attaching disk 62 and/or flange 124 to outer shell 108 (using, for example, plastic pins 134).

A coaxial RF feedline 136 may be directly connected to a predetermined impedance matching point 138 on disk 62 (the position of this point can be determined experimentally on prototypes and a hole 140 for establishing the connection can be cut through disk 62 during mass-production). Coaxial cable 136 can pass through a hole 142 cut through cylindrical wall 122. Diameters and thicknesses of the disks from which parts 104 and 106 are made (and, of course, the dimensions of the dies used in the stamping process) are carefully chosen so that the critical dimensions discussed in FIGS. 3 and 4 are present in the final fabricated structure.

Figure 7:
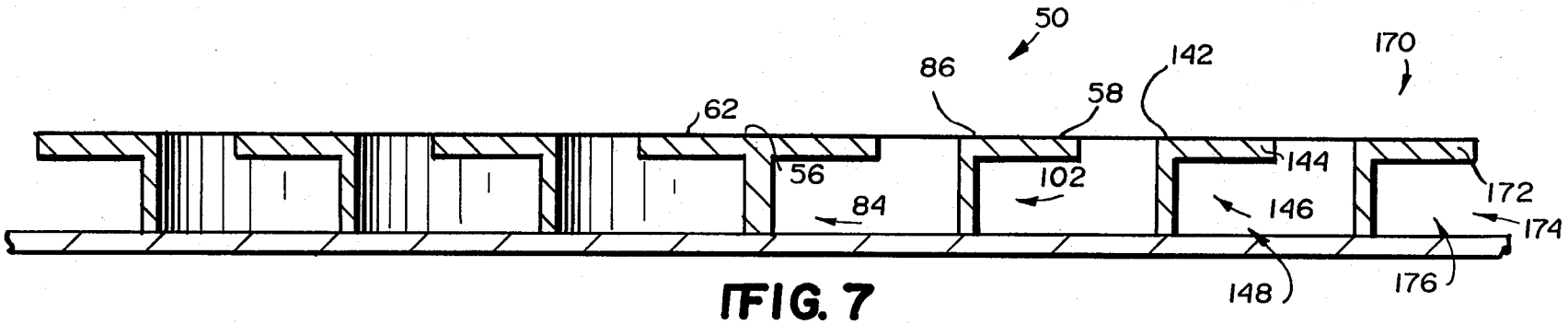
FIG. 7 is a side view in cross-section of a still further embodiment of the present invention having a circular radiator element and three annular parasitic elements.

As described previously, a single passive element 58 provides an appreciable reduction in angle of radiation of antenna structure 50. Additional concentric shorted rings 86 may be used to provide still lower angles of radiation (and thus, still further increase effective gain toward the horizon). FIGS. 7 and 8 show a further embodiment of antenna structure 50 including circular radiator element 56, annular passive element 58, a second annular passive element 142, and a third, outer passive element 170. Passive elements 142 and 170 have substantially the same structure as that of passive element 58 described previously, although they both have larger diameters than that of parasitic element ring 86 (since they are spaced radially outwardly from that ring).

Passive element 142 is concentric with elements 58 and 56 and includes a ring 144 which is coplanar with ring 86 and disk 62. The passive radiating slot 146 and associated resonant cavity 148 defined by passive element 142 is parasitically coupled to slots 84 and 102, and acts as a further director of radiation.

Passive element 170 is concentric with elements 58, 56 and 142, and includes a ring 172 which is coplanar with rings 86 and 144 and with disk 62. The passive radiating slot 174 and associated resonant cavity 176 defined by passive element 142 is parasitically coupled to slots 84, 102 and 146, and acts as a still further director of radiation.

The spacings between slots 102, 146 and 174 may nominally follow the 0.2 wavelength Yagi array spacing discussed previously, although actual spacings should be optimized through experimentation.

Further reduction of radiating angle can be achieved by providing still further concentric passive elements. The structure shown in FIGS. 7 and 8 (with three annular parasitic elements and circular radiating element 56) has been constructed and tested, and exhibited a relatively low angle of radiation (and thus, additional gain toward the horizon) and relatively broadband characteristics. Depending upon the application, however, the expense of providing more than two or three passive annular elements may not justify the further incremental improvement in antenna performance (indeed, in some applications, only one or no parasitic elements may be used in order to decrease fabication cost and complexity at the expense of decreased gain toward the horizon).

Figure 9:
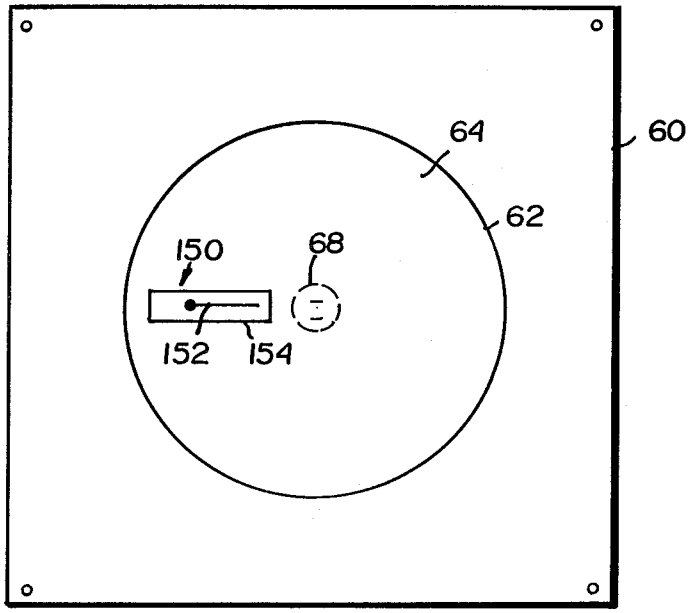
FIG. 9 is a top view in plan of a further embodiment of the antenna structure of the present invention, this embodiment having a circular radiator element and no parasitic elements and including a capacitive microstrip line stub resonant impedance matching network for obtaining a broadband impedance match.

As mentioned previously, antenna 50 as described has relatively broadband characteristics and thus can be operated over a relatively wide operating frequency range with acceptable impedance matching. However, it is often desirable in mobile radio applications to operate antenna structure 50 over a very broad range of operating frequencies (e.g., 820 MHz to 890 MHz) with acceptable VSWR (2.0 to 1 or less) over that entire range. To achieve this wide bandwidth, antenna structure 50 can be modified to include a microstrip line-type impedance matching network 150 of the type shown in FIGS. 9 and 10.

Matching network 150 includes microstrip line 152 disposed on a strip of insulative material 154, that insulative strip being disposed on disk upper surface 64. As shown in FIG. 10, coaxial cable center conductor 156 may be connected directly to microstrip line 152 using a conventional solder joint 158 or the like. Holes 160 and 162 may be drilled through disk 62 and insulative strip 154, respectively, to permit center conductor 156 to pass through the disk to microstrip line 152 without electrically contacting the disk. The capacitive reactance between microstrip line 152 and disk 62 in conjunction with the inductive reactance introduced by coaxial cable center conductor 156 (or, alternatively, the feed-through pin of a conventional RF connector used to feed antenna structure 50) provides a resonant circuit, resulting in a broadband impedance match.

Figure 13:
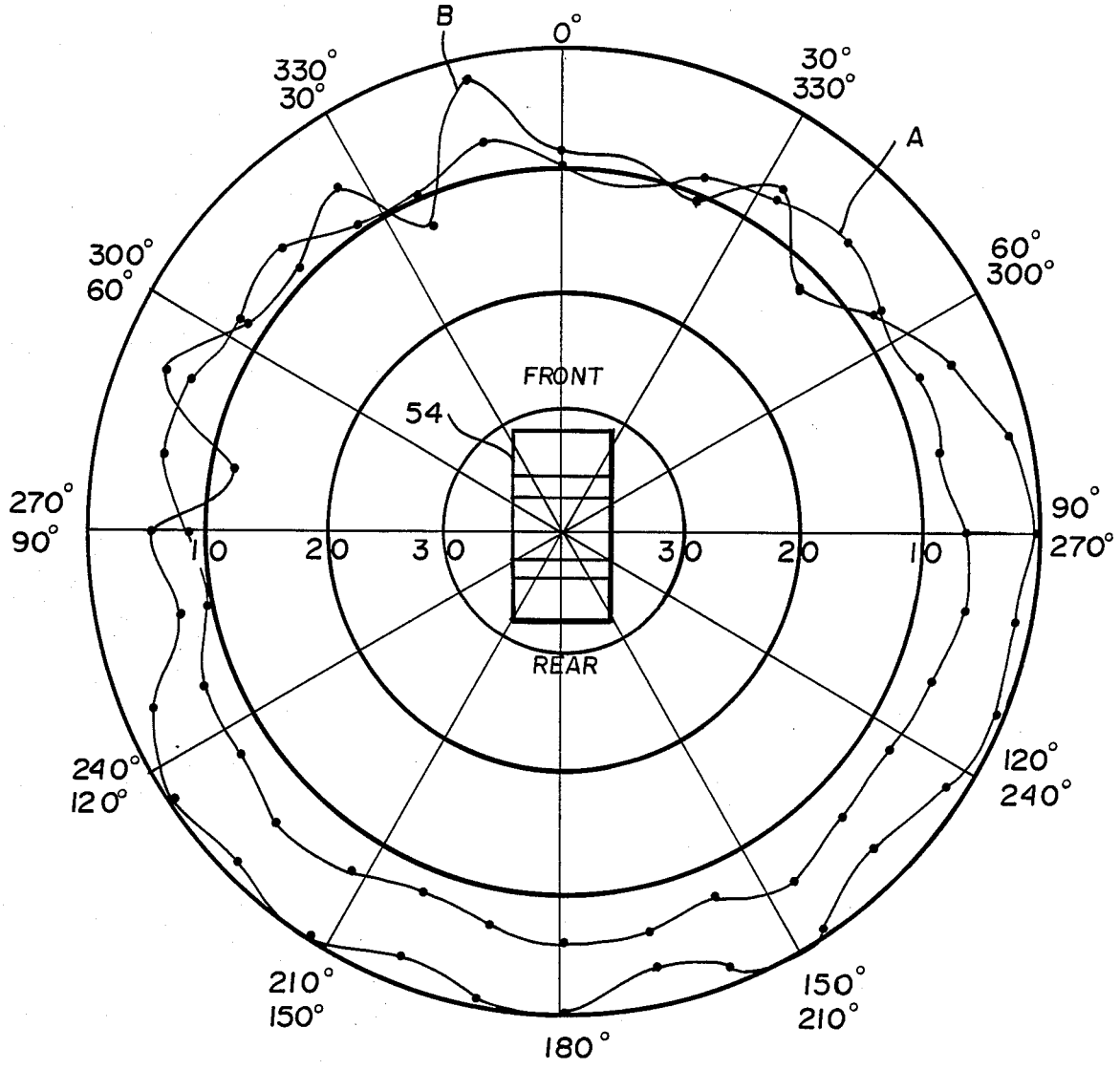
FIG. 13 is a polar plot showing actual field strength measurements of the vertically polarized radiation pattern of the antenna structure shown in FIG. 7 as installed in a passenger vehicle and also showing the radiation pattern of the prior art whip antenna shown in FIG. 1.

FIGS. 11–13 schematically show the RF radiation pattern of antenna structure 50 shown in FIG. 3 as installed within roof structure 52 of automobile 54. FIG. 11 graphically illustrates the vertically-polarized omnidirectional radiation pattern of antenna structure 50 in the x-y plane (plane of the horizon when disk 62 is oriented in that plane) and also the relatively low angle of radation in the z direction attributable in part to the effect of parasitic element 58 (this low angle of radiation is also graphically shown in FIG. 12). FIG. 13 is a polar plot showing two plots: The actual measured radiation pattern (field stength measurements) of antenna structure 50 shown in FIG. 3 as mounted within roof structure 52 (this plot is labeled "A"); and the plot of a trunk mounted quarter wavelength whip antenna (of the type shown in FIG. 1) mounted on the same vehicle (this plot is labeled "B").

Figure 14:
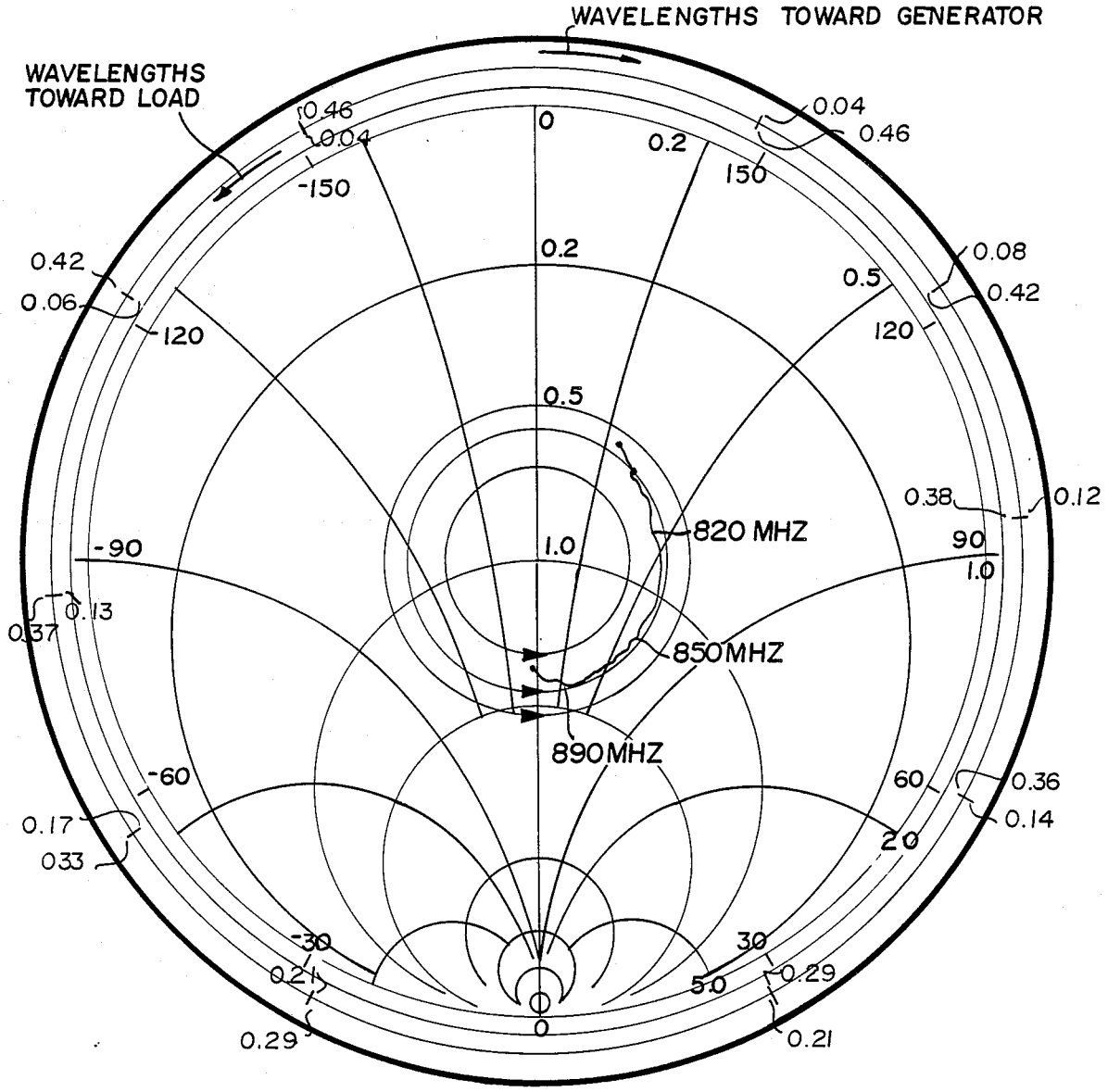
FIG. 14 is a Smith chart of input impedance of an antenna structure of the present invention measured over a frequency range of 820 MHz–890 MHz.

FIG. 14 is a Smith chart showing results of input impedance measurements for the antenna structure 50 shown in FIGS. 7 and 8. This chart demonstrates that a VSWR (voltage standing wave ratio) less than 2.0 to 1 over the range of 820 MHz to 890 MHz can be obtained.

FIG. 15 shows a further embodiment of antenna structure 50 having a discoid conductive reference surface 60 which has substantially the same size and shape as circular radiator element 56. This embodiment, which is attractive because of its symmetry, may be useful in applications where RF shielding below reference surface 60 is not required.

A new and advantageous antenna structure has been described which has a omni-directional RF radiation pattern, is inexpensive and easy to produce in large quantities, and can be constructed in a low profile package. The antenna structure is conformal (that is, it may lie substantially within the same plane as its supporting structure), and because of this and its small size, may be incorporated into the roof structure of a passenger vehicle. The disclosed antenna structure is ideally suited for use as a passenger automobile mobile radio UHF antenna because of these characteristics.

While the present invention has been described with what is presently considered to be the most practical and preferred embodiments, it is to be understood that the appended claims are not to be limited to the disclosed embodiments, but on the contrary, are intended to cover all modifications, variations and/or equivalent arrangements which retain any of the novel features and advantages of this invention.

What is claimed is:

1. A radio frequency antenna for installation in a vehicle, said antenna comprising:

a conductive reference surface;

a circularly shaped conductive radiator element of substantially less than one-half wavelength in diameter disposed above said reference surface by substantially less than one-fourth wavelength, said radiator element having an outer edge;

means for electrically shorting said circularly shaped element to said reference surface near the center of the circularly shaped element, said circularly shaped element and reference surface together defining a shorted annular cavity having a first circular radiating slot at said circularly shaped element outer edge;

a signal RF signal feed located between the reference surface and a matched impedance point on said circular radiator element, said point being spaced away from the periphery of said circular radiator element; and at least one further continuous annular conductive radiator element spaced radially outwardly form said first circular radiating slot and also disposed above said reference surface by substantially less than one-fourth wavelength, said further radiator element having at least one edge, said further radiator element and said reference surface together defining at least one further circular radiating slot at one of said further radiator element edges, wherein said antenna has a substantially omnidirectional radiation pattern.

2. A radio frequency antenna as in claim 1 wherein said further annular conductive radiator element includes an inner radius portion, and said antenna further includes means for shorting said further element inner radius portion to said reference surface to form an annular shorted circular radiating slot at its outer edge.

3. A radio frequency antenna as in claim 1 wherein said further radiating slot is located about 0.2 to 0.4 wavelength radially outwardly of said first radiating slot.

4. A radio frequency antenna as in claim 1 wherein said further annular conductive radiator element comprises director means for providing increased antenna gain at the horizon when said radiator elements and conductive reference surface are horizontally disposed, said director means including a passive parasitic director element having no directly connected RF feedpoint.

5. A radio frequency antenna as in claim 1, 2, 3 or 4 comprising a plurality of said further annular conductive radiator elements, each successive additional such further element being located radially outwardly of the just preceding one.

6. A radio frequency antenna as in claim 1 installed in the roof of a vehicle with the conductive reference surface disposed over a passenger section of the vehicle.

7. A radio frequency antenna as in claim 1 wherein said RF signal feed includes a predetermined length of microstrip transmission line disposed on said radiator element and connected to resonate with other feed connection components so as to provide a substantially matched RF impedance over a broadened band of frequencies.

8. A radio frequencies antenna as in claim 1 having an operational bandwidth including 825 MHz to 890 MHz.

9. A radio frequency antenna as in claim 1 wherein said conductive elements comprise die-formed aluminum structures.

10. A radio frequency antenna as in claim 1 wherein:

said circularly shaped radiator element includes a first part comprising a conductive material, said first part having a circular periphery and first and second opposing planar surfaces, said first part also having a depression in substantially the center of said first surface and a cylindrical portion with a frustoconical shape protruding from said second surface, said protruding portion surrounding a hollow inner space, said depression communicating with the hollow space within said protruding portion, said protruding portion having a distal terminus;

said further annular radiator element comprises a second part comprising a conductive material, said second part having a substantially cylindrical cavity surrounded by an outwardly extending flange, said cylindrical cavity terminating in a bottom planar portion;

said shorting means includes means for mechanically and electrically attaching said first part protruding portion terminus to said second part bottom portion; and said RF feed includes a single RF feedline connected between said second part and a predetermined impedance matching point on said first part, said point being spaced away from said first part circular periphery.

11. An antenna structure as in claim 10 wherein said flange is annular.

12. An antenna structure as in claim 10 wherein said flange has a width which is approximately half the diameter of the circular periphery of said first part.

13. An antenna structure as in claim 10 wherein the bottom of said second part substantially cylindrical cavity is circular and has a diameter which is substantially larger than the diameter of said first part.

14. An antenna structure as in claim 10 wherein an annular gap is defined between said first part periphery and said flange.

15. An antenna structure as in claim 10 wherein said first part first surface and said flange are coplanar.

16. An antenna structure as in claim 10 wherein said attaching means includes:

structure extending from said terminus; and at least one aperture defined through said bottom portion into which said structure is inserted.

17. An antenna structure as in claim 10 further including a sheet of conductive material coupled to said second part bottom portion.

18. An antenna structure as in claim 10 wherein said protruding portion is frustoconical where it joins said second surface.

19. An antenna structure as in claim 10 wherein said protruding portion includes a frustoconical portion and a cylindrical portion joined thereto, said cylindrical portion terminating in said terminus, said frustoconical portion being connected to the said first part circular periphery.

20. An antenna as in claim 1 wherein:

a rigid outer non-conductive shell covers a portion of the exterior of said vehicle;

said reference surface is defined by an inner conductive sheet spaced apart from said outer shell a second cavity being defined between said inner sheet and said outer shell;

said circular radiator element comprises a first circular conductive surface mounted to said outer shell and disposed within said second cavity;

said annular radiator element comprises a second conductive surface opposing and spaced apart from said first surface and disposed on said inner sheet;

said shorting means comprises an elongated cylindrical conducting structure connected to substantially the center of said first surface and disposed between said first and second surfaces; and said RF feed comprises transmission line means electrically coupled to said first and second surfaces for coupling radio frequency signals to and/or from said first and second surfaces, said transmission line means being directly connected to said first circular conductive surface at a single point spaced away from said first surface periphery, wherein the diameter of said first surface is selected so that an annular cavity terminating in a circular radiating slot is defined between said first and second surfaces.

21. A radio frequency antenna for installation in a vehicle, said antenna comprising:

a conductive reference surface;

a circularly shaped conductive radiator element of substantially less than one-half wavelength in diameter disposed above said reference surface by substantially less than one-fourth wavelength, said radiator element having an outer edge;

means for electrically shorting said circularly shaped element to said reference surface near the center of the circularly shaped element, said circularly shaped element and reference surface together defining a shorted annular cavity having a first circular radiating slot at said circularly shaped element outer edge;

a single RF signal feed located between the reference surface and a matched impedance point on said circular radiator element, said point being spaced away from the periphery of said circular radiator element; and at least one further continuous annular conductive radiator element spaced radially outwardly from said first circular radiating slot and also disposed above said reference surface by substantially less than one-fourth wavelength, said further radiator element having at least one edge, said further radiator element and said reference surface together defining at least one further circular radiating slot at one of said further radiator element edges, wherein said antenna has a substantially omnidirectional radiation pattern, and wherein:

said antenna is for installing in an automobile of the type including a rigid outer non-conductive exterior shell and an inner headliner layer spaced apart from said outer shell to define a second cavity therebetween;

said circularly shaped radiator element comprises a first circular conductive surface mounted to said outer shell and disposed within said second cavity;

said annular element comprises a second conductive surface opposing and spaced apart from said first surface and also disposed within said second cavity;

said shorting means comprises an elongated cylindrical conducting structure connected to substantially the center of said first surface and disposed between said first and second surfaces; and said RF feed includes transmission line means electrically coupled to said first and second surfaces for coupling radio frequency signals to and/or from said first and second surfaces, said transmission line means connecting to said first conductive surface at a single point, said single point spaced away from said circular conductive surface periphery, wherein the diameter of said first surface is dimensioned so that an annular resonantly-dimensioned cavity terminating in a circular radiating slot is defined between said first and second surfaces.

22. An antenna stucture as in claim 21 wherein said first and second surfaces are parallel.

23. An antenna structure as in claim 21 further including capacitive stub means, connected to said transmission line means, for introducing a capacitive reactance equal to the inductive reactance of a portion of said transmission line means at a desired operating frequency.

24. A radio frequency antenna for installation in a vehicle, said antenna comprising:

a conductive reference surface;

a circularly shaped conductive radiator element of substantially less than one-half wavelength in diameter disposed above said reference surface by substantially less than one-fourth wavelength, said radiator element having an outer edge;

means for electrically shorting said circularly shaped element to said reference surface near the center of the circularly shaped element, said circularly shaped element and reference surface together defining a shorted annular cavity having a first circular radiating slot at said circularly shaped element outer edge;

a single RF signal feed located between the reference surface and a matched impedance point on said circular radiator element, said point being spaced away from the periphery of said circular radiator element; and at least one further continuous annular conductive radiator element spaced radially outwardly from said first circular radiating slot and also disposed above said reference surface by substantially less than one-fourth wavelength, said further radiator element having at least one edge, said further radiator element and said reference surface together defining at least one further circular radiating slot at one of said further radiator element edges, wherein said antenna has a substantially omnidirectional radiation pattern and wherein:

a rigid outer non-conductive shell covers a portion of the upper exterior of said vehicle, and an inner non-conductive headliner layer is spaced apart form said outer shell, a space being defined between said headliner layer and said outer shell, said headliner layer bounding a passenger compartment of said vehicle;

said conductive reference surface is disposed on said headliner layer;

said circularly shaped radiator element comprises a circular sheet of conductive material, said cavity terminating in said first circular radiating slot located about the periphery of said circular sheet; and said RF feed comprises transmission line means, electrically coupled to said conductive sheet, for coupling radio frequency signals to and/or from said sheet, said transmission line means including means for directly connecting to said sheet at a point on said sheet spaced away from said sheet circular periphery.

25. A vehicle as in claim 24, wherein said reference surface is a thin layer of conductive material disposed on said headliner layer.

* * * * *